US005398894A

United States Patent [19]

Pascoe

[11] Patent Number: 5,398,894

[45] Date of Patent: Mar. 21, 1995

[54] VIRTUAL BLOCK CONTROL SYSTEM FOR RAILWAY VEHICLE

[75] Inventor: Robert D. Pascoe, Pittsburgh, Pa.

[73] Assignee: Union Switch & Signal Inc., Pittsburgh, Pa.

[21] Appl. No.: 104,875

[22] Filed: Aug. 10, 1993

[51] Int. Cl.[6] ..... B61L 25/00

[52] U.S. Cl. ..... 246/28 R; 246/62; 246/122 R

[58] Field of Search ..... 246/20, 27, 28 R, 62, 246/122 R, 21, 22, 23, 24, 25, 26, 63 R, 63 C, 63 A, 64, 73, 74, 28 D, 131

[56] References Cited

U.S. PATENT DOCUMENTS

| | | | |
|---|---|---|---|
| 3,251,989 | 5/1966 | Hughson | 246/28 R |
| 3,710,100 | 1/1973 | Perry | 246/28 R |
| 3,774,025 | 11/1973 | Auer et al. | 246/122 R |
| 4,027,840 | 6/1977 | Blair | 246/122 R |

FOREIGN PATENT DOCUMENTS

| | | | |
|---|---|---|---|
| 0403954 | 12/1990 | European Pat. Off. | 246/122 R |
| 0229878 | 11/1985 | Germany | 246/28 R |
| 3840288 | 5/1990 | Germany | 246/28 R |
| 0144257 | 6/1990 | Japan | 246/122 R |
| 0286465 | 11/1990 | Japan | 246/28 R |

*Primary Examiner*—Mark T. Le
*Attorney, Agent, or Firm*—Buchanan Ingersoll

[57] ABSTRACT

A virtual block system is provided in which a section of track is represented by a zone having a plurality of virtual track circuits. Communication between wayside and the vehicle is established within the zone, and may be used to provide the initial position of the vehicle to the carborne equipment. The carborne equipment can then calculate and up-date its position within the zone by using its initial position and sensor information relative to its movement within the zone. The actual position within the zone can be transmitted from the vehicle to the wayside equipment. The wayside equipment converts the actual position within the zone to a virtual track circuit occupancy. The wayside equipment may also use the train length to calculate one or more virtual blocks as being occupied. The wayside unit outputs the occupancy status, occupied or unoccupied, to the wayside interlocking equipment. The wayside equipment generates profile data which can be transmitted to the vehicle.

61 Claims, 10 Drawing Sheets

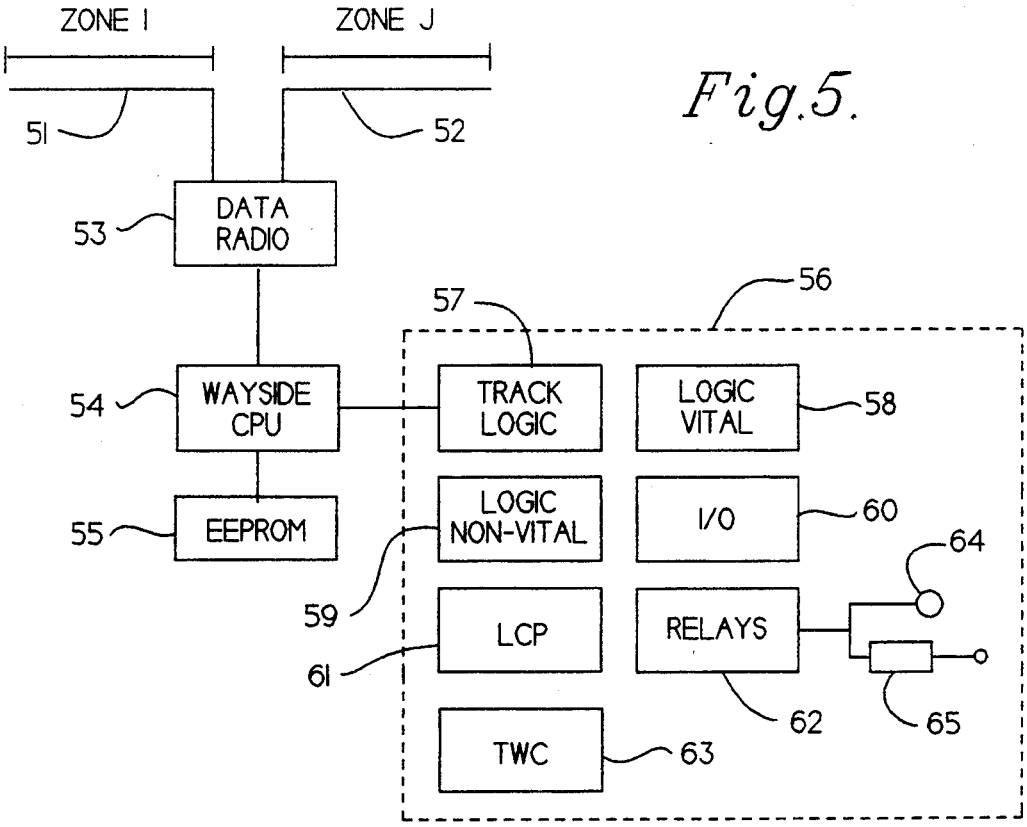
Fig.5.
Fig.11.
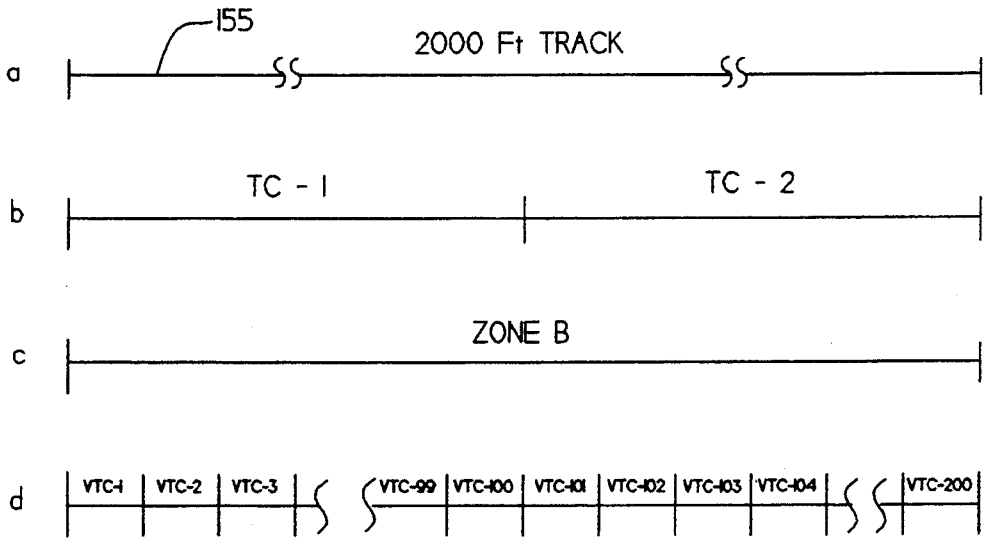

TRIP - STOP SYSTEM

NON EQUIPPED TRAIN CONTROL LINES WITH :

NON EQUIPPED FOLLOWING NON EQUIPPED
NON EQUIPPED FOLLOWING EQUIPPED

EQUIPPED TRAIN CONTROL LINES WITH :

EQUIPPED FOLLOWING EQUIPPED
EQUIPPED FOLLOWING NON EQUIPPED

VIRTUAL BLOCK CONTROL SYSTEM FOR RAILWAY VEHICLE

BACKGROUND OF THE INVENTION

Railway signal control systems typically use the track circuit block as the basic element of train location, and communication and control. Electrical signals applied to the length of track comprising a block is shunted by the rail vehicle axle and the change in signal is detected and is used to indicate a track block that this occupied. In addition, such track circuits also can be used to detect for broken rail, and establish communication from wayside equipment to moving rail vehicles, including, for example cab signals. Because of the operating requirements associated with track block signals the equipment used in each track circuit must provide for a vital operation of that track circuit. While block signals give reliable indication of the vehicle position, the limiting factor is the length of a given block. When a vehicle crosses two adjacent 1,000 foot block sections, the signal apparatus will detect the vehicle within a 2,000 foot length of track. Because train operation depends upon the conditions in front of and behind moving vehicles such 2,000 fool vehicle indication may effect operation in over a mile of track. When it is desirable to operate a high frequency of trains (short headways) such as in rush hour mass transit systems, the safe headway between trains must be maintained at a minimum distance so as to permit a high operating frequency of service. One of the ways this can be achieved is by increasing the number of individual track circuits and decreasing the length of each track circuit. However, to obtain shortened track blocks requires a proportionally higher number of track circuit equipment and can become cost prohibitive. Since many trains are operated either automatically or manually based upon the train conditions received through cab signal equipment, the train information available to cab signal is uniform within the block and cannot take into account information or conditions such as grade that may exist within a portion of a block. Track conditions which are appropriate for the train at the entering section of a block may be non-optimum for uphill sections in the exiting end of a block. Presently the information would default to the reduced condition which would be unnecessary in uphill grade areas. Such default does not result in optimum train operation. This disadvantage can be overcome by using a larger number of discrete track circuits. If the track circuits comprise 100 foot blocks, the headways can be significantly increased over that of the 1,000 foot blocks. However, unfortunately such 100 foot track circuits would require ten times the track bonds, vital track interlocking, and vital logic. It is therefore desirable to obtain the effects of a large number of small interval track circuits without the cost of installing and maintaining such large number of track circuits. In typical track circuit systems the vehicle speed is controlled via speed data transmitted to each vehicle as a function of track circuit occupancy. The vital wayside distributed logic generates what applicable speed data should be transmitted to the vehicles by monitoring the states of all the track circuits in a particular control line. Thus as a vehicle occupies a particular track circuit, the vital wayside logic determines what speed data to send to the vehicle via cab signal as a function of how many track circuits are unoccupied and other train conditions.

Other rail vehicle signal systems do not use traditional track circuits but instead use a moving block system. The moving block system uses an automated train control system in which a following train receive information of the velocity and position of a train ahead of it. A central control function has a continuous dialogue with all trains on the system. The central control knows the velocity and position of each train on the system at all times. A vital train to wayside communication system provides position information to each train concerning the respective lead train to it. In some systems the central control function also provides velocity information concerning the lead train to the respective following train. On-board calculations then compute the speed profile to maintain at least a safe braking distance between itself and the lead train. The moving block system uses vital logic at the central control facility to provide the position of each train on the system, and to determine which information is fed to each train. Advantages of such a system are the lack of equipment associated with discrete track circuits, and the moving block system can result in reduced headways since the train control is based upon .safe braking distances to the specific location of the lead train rather than assuming the lead train to be occupying a whole track circuit block. Some of the disadvantages of such a moving block system are the reliance upon a central control facility to vitally process the information and transmit that vital information across the system. Failure at the central control facility can result in a system-wide shutdown as no information will be available to any train on the system.

SUMMARY OF THE INVENTION

The invention improves upon the physical track circuit operation by creating a large number of virtual track circuits. A large zone is established which can contain a large number of virtual track circuits or blocks. A wayside control unit or CPU uses the vehicle's actual track location or position in the zone to establish the occupied or unoccupied condition of the virtual track circuits. The vehicle location can be determined by providing a zone signal to the vehicle to establish the vehicle's actual position upon initially entering the zone. Using its initial position from receipt of the zone signal, a carborne unit can calculate its position within the zone using sensor information for its movement, such as a tachometer. The vehicle's position can then be periodically, or continuously transmitted to the wayside equipment. With the information concerning the vehicle's actual location, the wayside equipment can translate the position into an occupancy of certain virtual track circuits. The wayside unit can then output the track circuit information for its virtual track circuit indicating the unoccupied virtual track circuits to the interlocking equipment. Using the occupancy information from the virtual track circuits the interlocking equipment can provide interlocking information to the system and profile data to the specific vehicle within the zone.

DESCRIPTION OF DRAWINGS

FIG. 5 a block diagram of a presently preferred embodiment of wayside equipment which would interface with equipment such as that shown in FIG. 4.

FIG. 11 is a diagrammatic representation of a 2,000 foot track section in FIG. 11*a*. FIG. 11*b* shows the same 2,000 foot track section having two discrete track circuits. FIG. 11*c* shows the same 2,000 foot track circuit as implemented having a single zone B. FIG. 11*d* shows zone B represented as having 200 virtual track circuits.

DESCRIPTION OF EMBODIMENTS

Figure 1A:
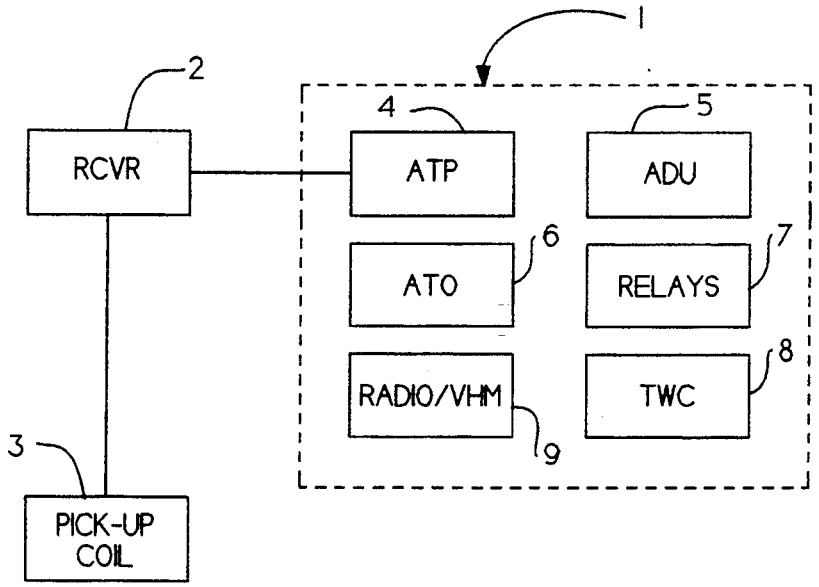
Fig.1a. (Prior Art)
FIG. 1*a* is a block diagram of typical carborne equipment used to pick-up track circuit signals and process onboard the rail vehicle.
Figure 1B:
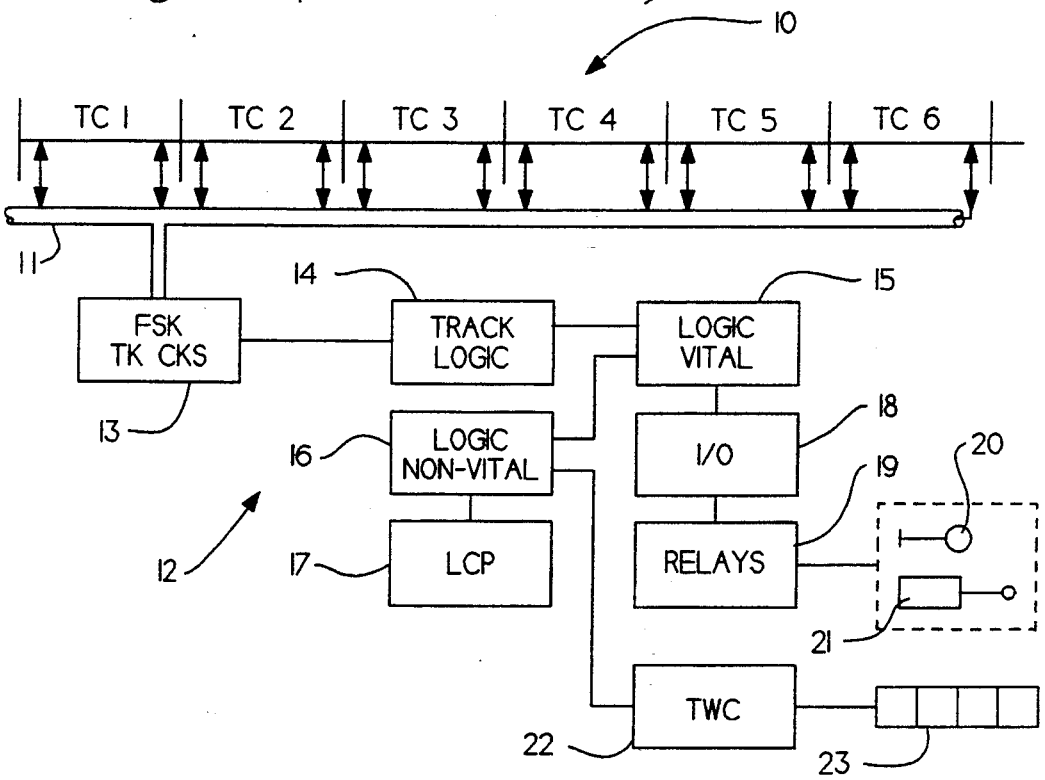
Fig.1b. (Prior Art)
FIG. 1*b* shows a typical arrangement of track circuit blocks TC1 through TC6 which are connected into a track circuit and wayside equipment such as found in interlocking rooms.

To understand the inventions it will be helpful to first describe a traditional system as shown in FIGS. 1*a* and 1*b*. FIG. 1*a* represents the carborne equipment used in a physical track circuit based traditional system using fixed blocks. Cab signals are picked-up through a coil 3 mounted on the vehicle. The signals from the pick-up coil 3 are deciphered by the receiver 2 which provides an output to the cab unit 1. The automatic train protection unit (ATP) 4 provides for functions such as speed limit enforcement, braking and propulsion control, door control, vehicle identification, and interfacing to other systems. A non-vital automatic train operation 6 controls the vehicles propulsion and braking system to ensure proper speed regulation and station stopping. An aspect display unit (ADU) 5 provides visual information to the operator and as a means for manual operation of the vehicle. A train to wayside communication (TWC) 8 provides for non-vital communication between the vehicle and wayside. Another unit 9 controls the radio communication and the vehicle health monitor (VHM). Relays 7 within the cab unit 1 are provided for interfacing with other equipment such as train lines to provide signals for multiple vehicle consists.

FIG. 1*b* shows a typical fixed block system of track circuits 10. These circuits TC1 through TC6 may be of different fixed lengths, although they are shown as all having the same length. Each of the individual track block sections TC1 through TC6 are connected through wiring via track wayside cable 11 to related track circuit transmitters and receivers 13. Track circuit transmitters 13 can be of the frequency shift keying (FSK) type having modulated encoded signals. Track circuit receivers in 13 provide information on track occupancy from each of the respective blocks TC1 through TC6, and provide cab signal signals to trains that occupy such track circuit blocks. Traditionally wayside controls have an interlocking room which provides functional control for a number of adjacent track circuits. The wayside equipment 12 located in such interlocking room would typically include track logic 14, vital logic 15, input/output equipment 18, relays 19 for operation of wayside signal equipment such as aspect 20 and switch machines 21. Additionally, the interlocking room would include non-vital logic 16 and a local control panel 17. For radio communication to trains, the wayside logic 12 would include a non-vital train to wayside communication unit 22 having an output 23.

Communication equipment 22 it is understood can be used to communicate with similar equipment TWC, 8, within the carborne equipment shown in FIG. 1*a*. Each vehicle on the system would normally be equipped with the carborne equipment shown in FIG. 1*a*. Such a system would be composed of a number of interlocking rooms such as shown in FIG. 1*b* each having a number of corresponding discrete physical track circuit blocks.

In the system of FIG. 1*a* and FIG. 1*b* the vital logic is generally performed in the wayside equipment and a vital digital track signal conveys data to the ATP, 4, via an electromagnetic coupling between the rails and the track circuits 10 and the coil pick-up 3. The train to wayside communication system is non-vital and is used to exchange non-vital data information between the vehicle and wayside.

Figure 2:
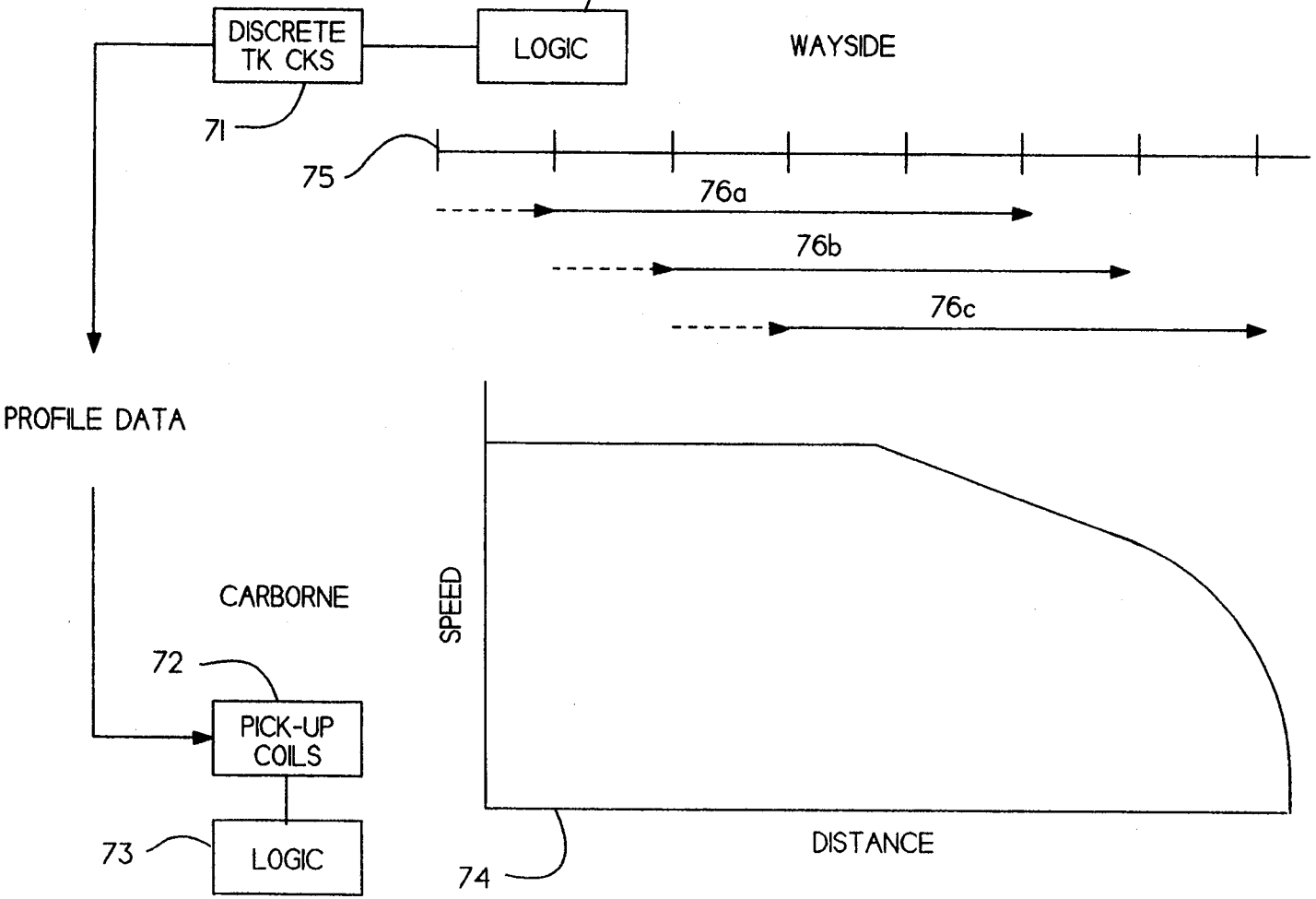
Fig.2. (Prior Art)
FIG. 2 is a diagrammatic representation of the wayside and carborne interface with representative control lines.

The information flow is depicted in FIG. 2 for the system shown in FIG. 1*a* and FIG. 1*b*. The wayside track circuits 71 detect the position of the rail vehicle in a specific track circuit block. Logic 70 uses this information along with other track information such as direction of the train, and the occupancy of other track circuits to generate profile data which the track circuit 71 sends to the vehicle as a cab signal. The profile data is picked-up through the magnetic coupling of pick-up coil 72. The carborne logic 73 now interprets the data to implement automatic train protection and automatic train operation. Typical profile data would include line speed, target speed, and the distance to go until the target speed must be implemented. Once the vehicle's control system receives and decodes this data the vehicle is vitally controlled using speed versus distance profiles such as 74. The vehicle may have tabled grade information in the form of PVI locations versus grade that can be used in the construction of a braking profile. Additional information for each track circuit location, track circuit ID, and the track circuit length may also be stored onboard the vehicle. The onboard control system can then calculate from its speed and distance to go the necessary braking or deceleration rates required. Diagram 74 shows a speed distance profile such as calculated by the logic 73. 75 shows a number of serial track circuit blocks having fixed lengths and train control line 76*a, b, c,* which represent the vehicle as it passes through such blocks, showing its calculated stopping distances or headways. As can be seen, track circuits rely upon a full section or block to detect the presence of a vehicle within such a given block. Therefore even though a train is about to leave a lengthy block the entire distance of such block will be considered to be occupied. If the blocks are short, such as 100 foot or less, this is not a problem in limiting headways and increasing traffic on the system. However, costs associated with such small blocks are exceedingly high. In addition, the central control facility must be very large to administer the vital control for such a large number of small track circuits.

Figure 3:
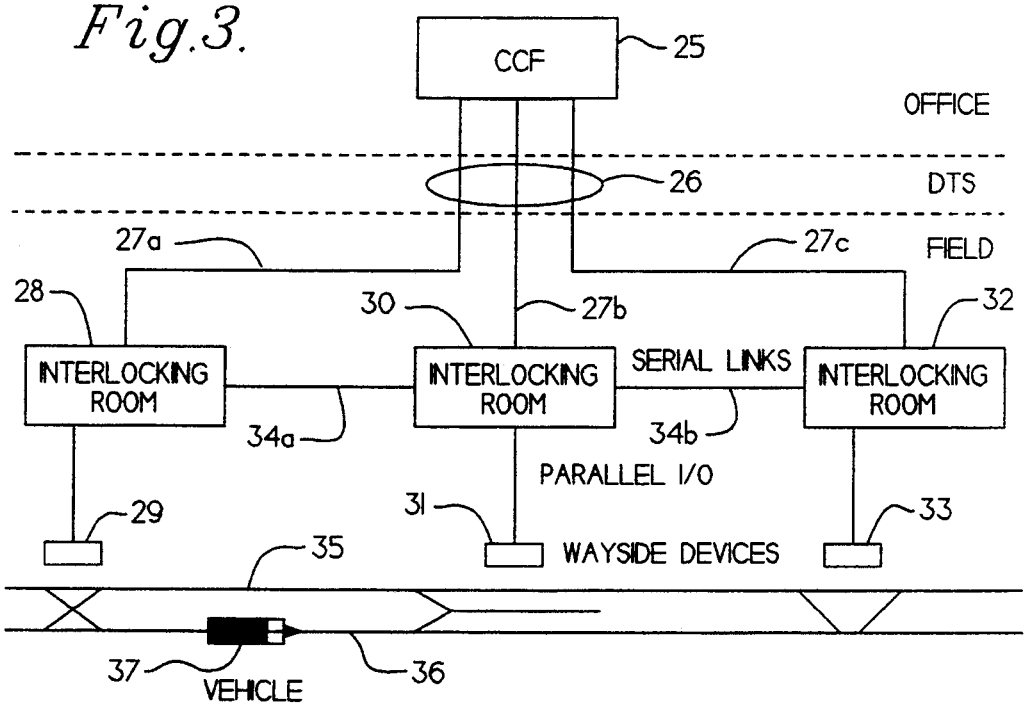
FIG. 3 is a block diagram of a presently preferred embodiment using vital distributed architecture having vital logic performed in the interlocking rooms distributed along the wayside.

Shown in FIG. 3 is a system which can be used with an embodiment of the invention, having a central control facility (CCF) 25. The CCF is connected to a number of interlocking rooms through use of a data transmission system 26. Serial links 27*a*, 27*b*, and 27*c* connect respective interlocking rooms 28, 30, and 32. Serial links 34*a* and 34*b* interconnect interlocking rooms 38, 30, and 32 so that information relating to adjacent track conditions can be passed between interlocking rooms and used to determine track operations by each interlocking room. The interlocking rooms also control wayside devices 29, 31, and 33. In operation the vehicle 37 moving on either tracks 35 or tracks 36 would be controlled through a vital distributed architecture permitting the system to function with or without a non-vital CCF. Vital logic can be performed in the interlocking rooms distributed along the wayside. Vital communication links exist between adjacent interlocking rooms that convey specific data required for passing vehicles between interlocking rooms. Vital data would also be passed from each interlocking room 28, 30, 32, to vehicle 37. Vehicle 37 would also transmit information to the interlocking room responsible for the track upon which the vehicle is then positioned.

Figure 4:
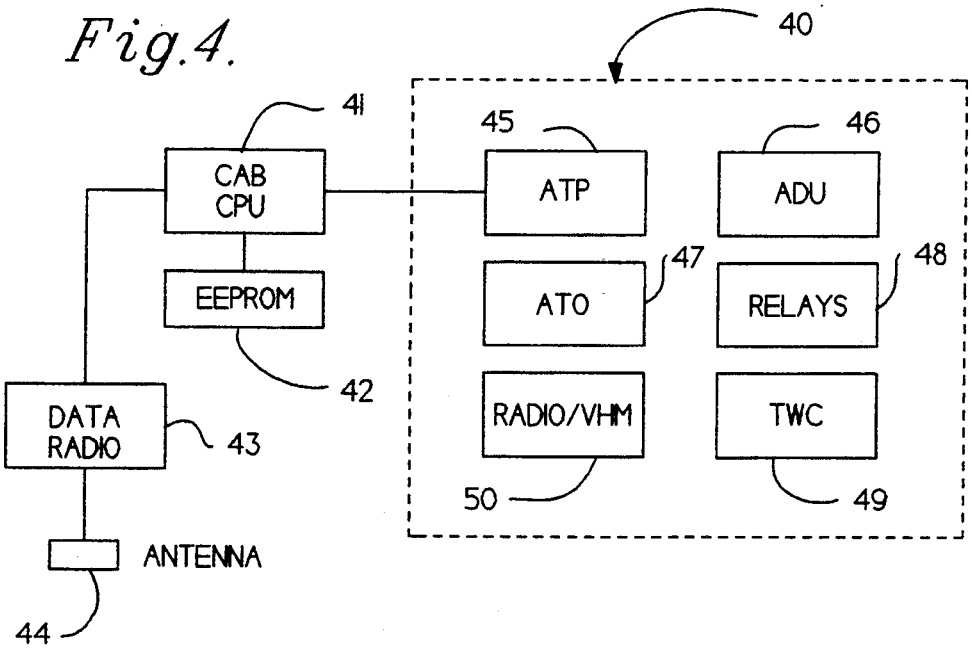
FIG. 4 is a block diagram of a presently preferred embodiment of carborne equipment.

FIG. 4 shows a carborne equipment for an embodiment of the invention using a cab unit 40. It will be appreciated that cab unit 40 can be similar to the cab unit 1 shown in FIG. 1*a*. The automatic train protection unit 45, aspect display unit 46, and automatic train operation unit 47 function similar to those previously described. Also, relays 48, track to wayside communications unit 49, and radio/vehicle health monitor 50 function similar to those described with respect to FIG. 1*a*. However, unlike the fixed track circuit carborne unit shown in FIG. 1*a*, this embodiment uses a cab central processing unit (CPU) 41 and an EEprom 42 to communicate with the cab unit 40. Wayside information is established through a two-way communication link using antenna 44 and vital data radio 43, which also communicates to CPU 41.

FIG. 5 shows a wayside equipment using one embodiment of the invention. Instead of having a number of fixed physical track circuit blocks, one or more zones of vital radio link are established wayside in relation to a given interlocking room 56. In this case two zones, zone I and zone J are established by respective transmission lines 51 and 52. A vital data radio 53 is used to transmit and receive information from vehicles in zone I or J. The signals from the radio are received by CPU 54 which also prepares signals for transmission to the data radio 53. The CPU 54 also communicates to the interlocking room equipment 56. As can be seen, interlocking room 56 can be similar to the interlocking room equipment 12 shown in FIG. 1*b*. Only the FSK track circuits 13 are missing. Track logic 57, vital logic 58, and non-vital logic 59 operate similar to track logic 14, vital logic 15, and non-vital logic 16 of FIG. 1*b*. The local control panel 61 provides local operation of the equipment similar to that shown at 17 in FIG. 1*b*. Input/output controls 60 and relay 62 perform similar functions to 18 and 19 respectively in FIG. 1*b*. Aspect 64 and track devices 65 are operated by relays 62. The track to wayside communication equipment (TWC) 63 can provide similar non-vital communication as was described with regard to reference 22 in FIG. 1*b*.

In operation as the carborne equipment shown in FIG. 4 enters a wayside zone, the cab CPU 41 is advised of the position of the vehicle at the entering end of the zone. This is usually done by antenna 44 receiving a zone signal from the respective transmission line such as 51 or 52 shown in FIG. 5. In some embodiments the cab CPU will have information available in its memory 42 so that from the identity of the zone the cab will be able to look up certain information such as length of the zone and track conditions within the zone. The cab CPU 41 can now through use of its initial position at the zone and its movement calculate its actual position within the zone. The vehicle may integrate speed time to arrive at distance from its initial zone entering point, or it may sense wheel rotation by use of tachometer generators located on the wheels or axles. It can therefore at all times during its presence in a given zone calculate its position within such zone. As it calculates its position, it periodically or continuously broadcasts from data radio 43 and antenna 44 its position within the zone. Transmission line, such as 52, within zone J can detect these periodic transmissions of vehicle position. This vehicle position signal is deciphered by wayside receiver 53 which sends this position to wayside CPU 54. The wayside CPU 54 converts the vehicle position into a occupied signal for a virtual block within said zone. The wayside CPU 54 divides each zone into a high number of small length virtual blocks. Because there is no track circuit corresponding to these virtual blocks, the size of the virtual block is not restrained. A virtual block of 50 or 100 foot can easily be achieved in wayside CPU unit 54. Wayside CPU 54 then outputs an occupied signal for whatever virtual block or blocks the vehicle occupies, and an unoccupied signal for corresponding unoccupied virtual blocks. Its output is to the wayside interlocking room equipment 56 and is received by track circuit logic 57. Track circuit logic 57 behaves as if it is connected to a large number of actual physical track circuits. The predetermined number of virtual track circuits which wayside CPU unit 54 uses in a given zone is programmed in the memory EEprom 55. The interlocking room equipment 56 then performs its normal operation such as control of aspect 64 and switch devices 65. In addition the wayside interconnecting room equipment 56 generates profiled data based upon the virtual block occupied by the vehicle. The profile data is then fed from the interlocking room 56 via the wayside CPU 54 and data radio to the respective transmission line 52 for transmission to the vehicle within the zone.

In using the embodiments of FIGS. 4 and 5, the physically track circuitry is eliminated and replaced with zones of transmission. The transmission zones may use any type of transmitting antenna, such as 51, 52, which may be lossy coax, or other vehicle to wayside transmission devices. This transmission technique permits both the wayside and the vehicle to communicate with each other in identified zone locations along the wayside. The result is that vital wayside logic thinks it is interfaced with many short length physical track circuits. In fact, no actual track circuits need be used at all. In the embodiment shown in FIG. 5 each zone is uniquely identified and the length represents approximately half the length between adjacent interlocking rooms.

Figure 6:
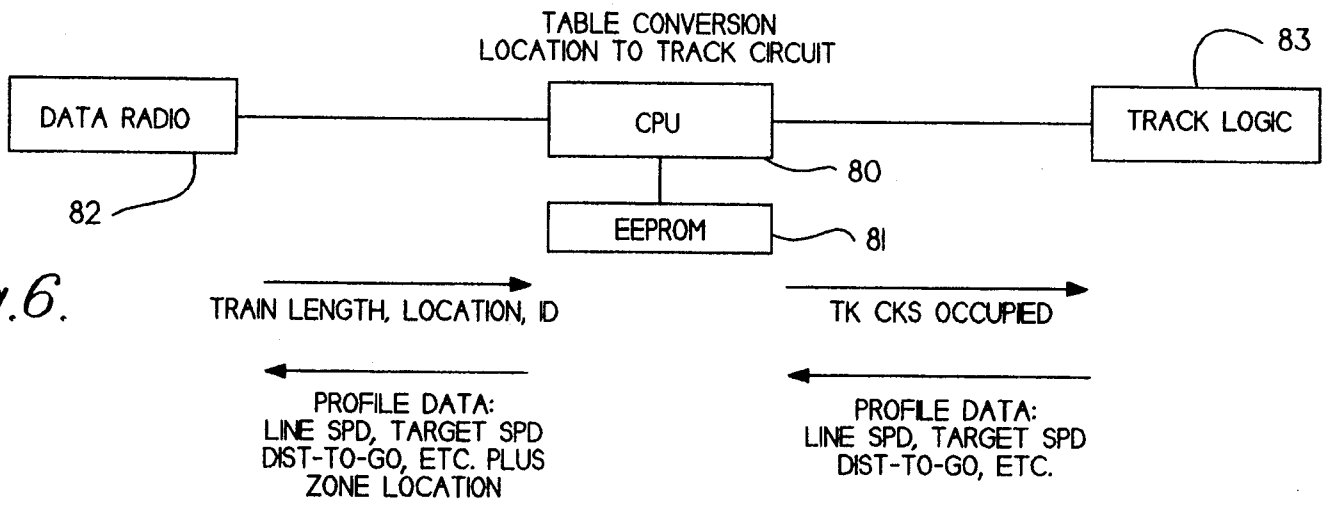
FIG. 6 is a diagrammatic representation of the data transmitted between the wayside and the vehicle to convert the train location to a virtual track circuit representation.

The functional data transmitted between the wayside and the vehicle is shown in FIG. 6. In this diagram the location of the vehicle received on wayside data radio 82 is converted to a virtual track circuit position by CPU unit 80 which is located wayside. Track logic 83 then uses the virtual block occupancy signals to generate profile data. The data radio provides the train length, location of the train, and the identity of the train. The CPU, 80, can then calculate the block or blocks which would be occupied if the virtual track circuits actually existed. The output is in the form of information of virtual track circuit occupied or unoccupied. The direction of the arrows shows the data from wayside to vehicle and from vehicle to wayside. As can be seen, the wayside transmits to the vehicle the required profile data as a function of the track circuits that are not occupied. These track circuits are determined by the CPU, using tabled EEproms 81. The proms have a predetermined number of virtual track circuits such as 100 foot lengths, which can be located by a physical benchmark, such as the end of the zone. For example if 100 foot virtual track circuits are to be used and the zone is 1,000 foot in length the prom would have ten 100 foot serially connected track circuits. When the vehicle transmits its location train length and ID to the data radio 82 the wayside CPU 80 converts the vehicle's location to the number of track circuits occupied. The occupancy of the virtual track circuits is then sent to the wayside track logic 83 where the profile data is generated. In transmissions back to the vehicle the wayside CPU 80 can send the profile data plus any additional data such as the location of the zone and the identity of the zone.

Figure 7:
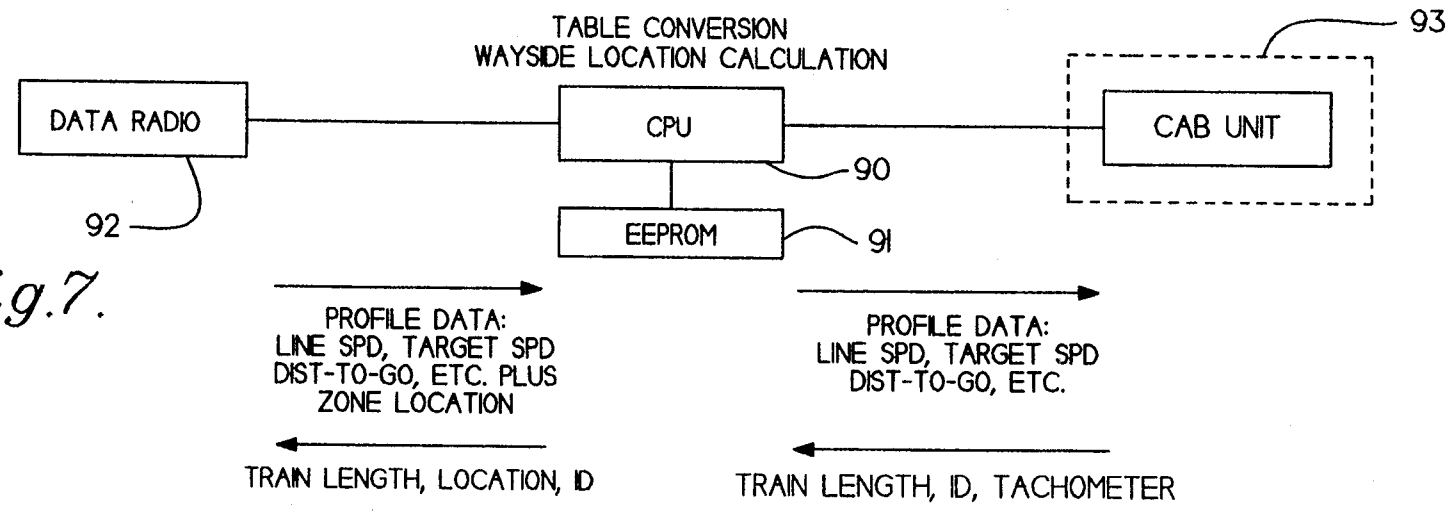
FIG. 7 is a diagrammatic representation of the flow of data to and from the carborne equipment to convert wayside location to profile data.

FIG. 7 shows the data flow for conversion of information to wayside location. The cab data radio 92 senses an initial position on the track, such as the entering end of the zone. When the zone location is first sensed and the zone identity determined from the memory 91, the CPU knows its initial physical position on the track. It has also been receiving profile data such as line speed, target speed, distance to go, and other track condition information. The profile data has been passed through the CPU 90 to the cab unit 93. However once initiated into the zone the CPU 90 in the carborne equipment begins to calculate the train location. It can do this in a number of ways, such as by sensing its movement. One embodiment would be to use the tachometer signal associated with the wheel movement. Each tach pulse represents a specific distance travelled by the vehicle, and this distance can be added to the initial position to give the vehicle its location at any time it is within the zone. In addition, the EEprom or memory unit 91 may contain look-up tables for the specific zones on the system so that the train will be able to verify the specific length of any given zone and accurately calibrate its inputs. Either the cab unit 93 or prom 91 can also provide the train length. This information will be used by the wayside CPU to calculate the number of virtual blocks occupied. The cab CPU then outputs the train length, location, and train ID to the carborne data radio 92.

The vehicle receives profile data from the wayside. In addition to the profile data, the CPU receives the zone location and the zone ID. The CPU 90 and its related prom 91 has stored, the physical location of the beginning of each unique zone. The existing carborne cab unit 93 can supply the carborne CPU 90 with its train length, train ID, and tack meter pulses. The cab unit 93 may be the same as used in fixed track circuit cab units, such as 1 in FIG. 1*a*. This ability to use the cab unit ATO, APO, and ADU of physical track circuit units makes the virtual block system of this invention particularly flexible. Similarly the fact that wayside interlocking room equipment of existing fixed physical block systems can be utilized to provide the advantages of the virtual block system is highly advantageous to cost and flexibility.

Figure 8:
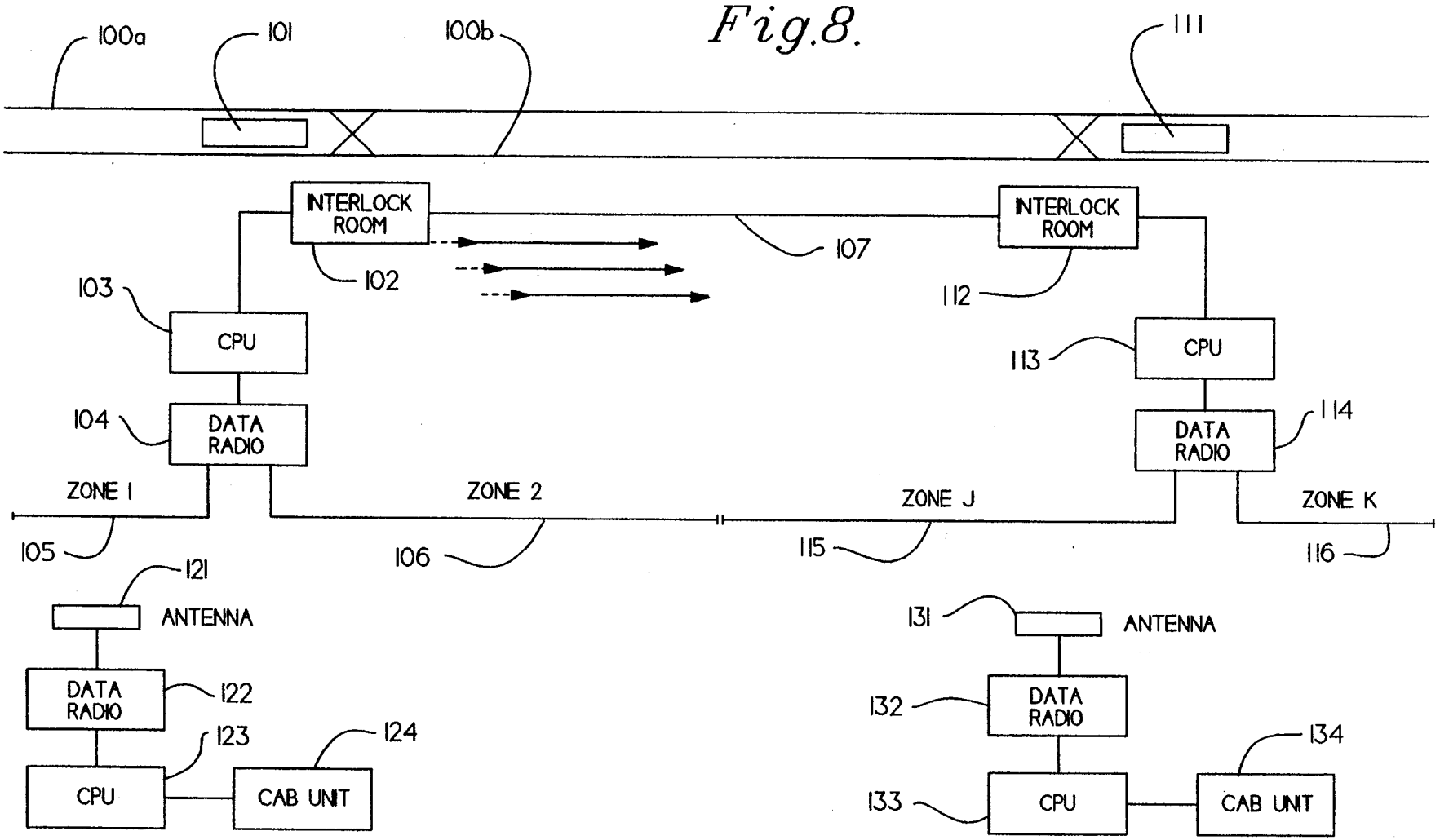
FIG. 8 shows a diagrammatic representation of a presently preferred embodiment using two interlocking rooms.

FIG. 8 illustrates a block diagram of one embodiment of the invention for two interlocking rooms. This system shows how existing interlocking rooms 102, 112, and vehicle cab units 124 and 134 can be utilized. While the interlocking room equipment and cab units, 102, 112, 124, and 134, were designed for very specific physical track circuits the advantages of the virtual block system can be had utilizing existing equipment. Assuming the previous discrete track circuit blocks were 1,000 foot in length, such a system could not be utilized with virtual track circuit blocks of 100 foot length. Vehicles 101 and 111 are operating on parallel tracks 100*a* or parallel tracks 100*b*. Vehicles 101, 111, each contain a carborne equipment including an antenna, a data radio, a cab CPU, and a cab unit, 121 through 124, and 131 through 134, respectively. Interlock rooms are connected by a data link 107, and each data room has a CPU and a data radio, 103, 104, and 113, 114. As can be seen, zone 1 and 2 are controlled by interlock room 102 through its respective CPU 103. Similarly zone J and K are controlled through interlock room 112 and its respective CPU and data radio 113 and 114. The wayside transmits profile data to each vehicle in the system. The specific profile data transmitted to the vehicle is a function of how many virtual track circuits are unoccupied. This logic is stored in the interlocking-rooms 102 and 112 as control line or speed selection networks. The interlocking rooms 102 and 112 also interface to signals and switch machines via vital relays (not shown in FIG. 8). Each crossover from track 100*a* to 100*b* would have a physical track circuit used for detector locking. The traversing of the vehicle from one zone to the next zone is communicated via the vital serial link 107 connecting adjacent interlocking rooms. Each vehicle 124, 134 would each communicate its respective wayside physical location via its respective data radio 122, 132, and antennas 121 and 131. Zone 1, it is to be understood, is to be composed of a plurality of virtual track circuits, each having a much smaller length than the actual physical length of zone 1. Generally zone 2, J, and K would also be composed of a large number of virtual track circuits. Interlock rooms 102 and 112 interface with respective wayside computers 103 and 113. The interlock rooms would not be required to know that they were being operated with virtual track circuits, and in fact could be operated as if they were connected to actual physical track circuit equipment. In some embodiments it may be desirable to use both virtual and actual track circuits in the same interface room. The wayside data radios 104 and 114 are in communication to the carborne data radios 122 and 132. This creates a communication dialogue between each vehicle and its applicable wayside zone. The frequency of this communication could be periodic and could occur every second or less. For a typical system, the baud rate for this data could be 2,600 bits per second because of the small amount of data passed between the vehicle and the wayside, typically on the order of 9 bytes or 98 bits. The band width of the frequency shift keying modulation and communication system could be 19.2K hertz. The communication link 107 permits the orderly passing of the vehicle between zones 2 and zone J. To properly prepare its profile data and interlocking, interlock room 102 would be advised of the occupancy condition of the virtual track circuits adjacent to zone 2. Interlock room 112 would provide this information the same as if actual track circuits were being used within that zone.

Figure 9:
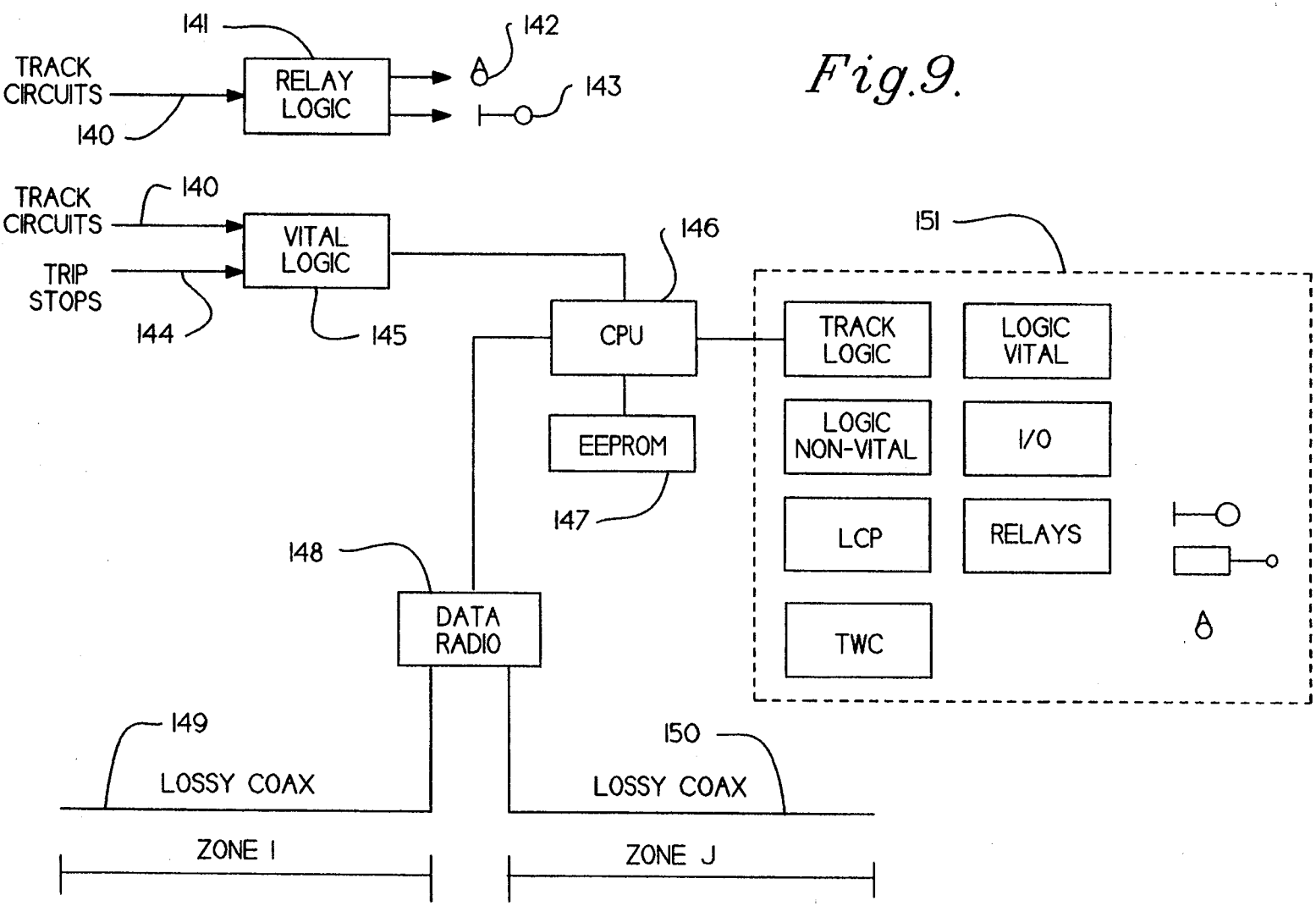
FIG. 9 is a diagrammatic representation of an embodiment in which the invention is operated in conjunction with traditional track circuit equipment.
Figure 10A:
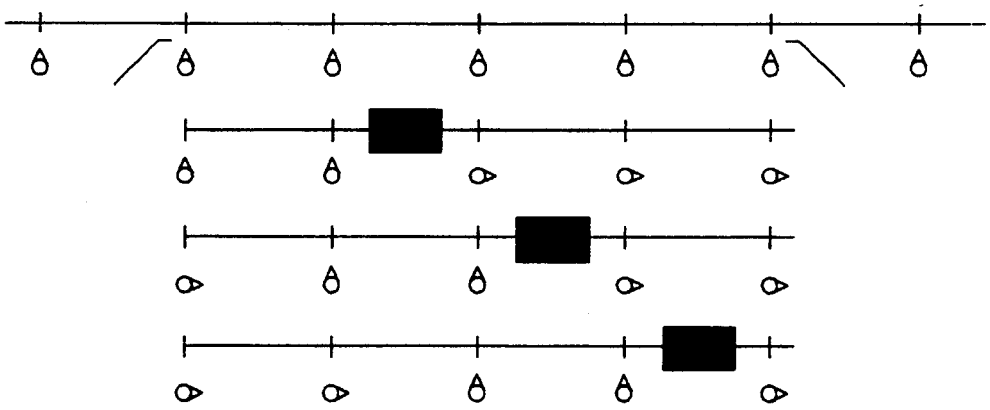
FIG. 10*a* is a diagrammatic representation of a trip stop system.
Figure 10B:
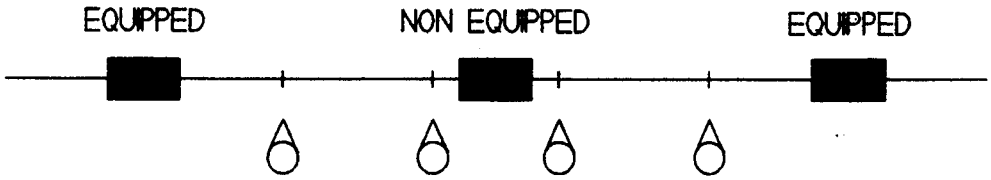
FIG. 10*b* shows control lines of an operation using equipped and non-equipped vehicles.

The virtual block system of this invention can be overlaid on an existing signal system very easily. An example of this overlay would be a traditional trip stop wayside signaling system, such as shown in FIG. 10*a*. The combined system would have both equipped and non-equipped vehicles traversing the wayside. The equipped vehicles would have the carborne virtual block package such as shown in FIG. 4 or equivalent. The non-equipped vehicles would have only operators controlling the vehicles via wayside signals. For the wayside virtual block system to track non-equipped vehicles, the system requires input from the existing signaling system and also vital control of the trip stops. FIG. 9 shows a configuration with these provisions. The track circuit inputs 140 uses relay logic 141 to control trip stops 142 and wayside aspects 143. In addition, the track circuit signal 140 and trip stop signal 144 is input into vital wayside logic 145. The vital logic unit 145 can be of prior art design, such as logic sold under the trademark MICROLOCK by Union Switch & Signal Inc. and may be programmed in the traditional manner. The equipped train's position is determined by the position signal received in zone I or J from transmission lines 149 or 150 respectively. Data radio 148 receives such signal and communicates the train position to CPU unit 146. The non-equipped train's position is determined by the vital logic 145 in combination with the CPU 146. When the vital logic 145 advises the CPU of the non-equipped vehicle's position, the CPU then passes that location on to the wayside control unit 151 as a virtual track circuit or circuits occupied. In addition to information concerning the zone EEprom 147 may contain information relating to specific trip stop conditions. If required the CPU 146 can be used to drive down the applicable trip stops in the combined signaling system for only equipped vehicles. Non-equipped vehicles follow the yellow or green control lines of the existing system.

The existing trip stop system keeps vehicles separated a safe braking distance, as shown in FIG. 10*a*. The existing trip stop system never permits two trains in the same block. This fact can be used by the virtual block system wayside CPU to determine the location of non-equipped trains or vehicles. The wayside equipment can track the position of the non-equipped trains via the assumption that the longest non-equipped train in the system is the length of all of the non-equipped trains. The combined equipped and non-equipped system can respond to the four combinations that exist. These four combinations are: equipped trains following equipped trains; non-equipped trains following non-equipped trains; equipped trains following non-equipped trains; and non-equipped trains following equipped trains. The four combinations of equipped and non-equipped trains are handled by a convolution of existing control lines and the new control lines generated by the wayside virtual block system. The two cases of non-equipped trains following non-equipped trains, and non-equipped trains following equipped trains use the existing control lines.

Figure 10C:
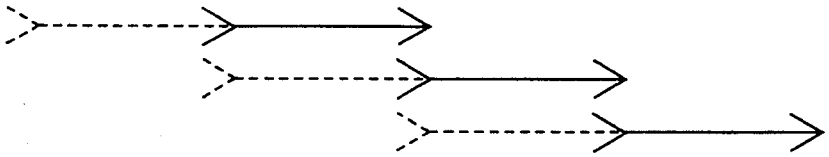
FIG. 10*c* is a control line diagram showing operation with equipped and non-equipped trains.

FIG. 10*c* illustrates these two combinations of equipped and non-equipped trains. The existing wayside signaling system responds to train shunts only. The existing signaling system does not know if an equipped or a non-equipped train is shunting its actual track circuit and responds properly.

Figure 10D:
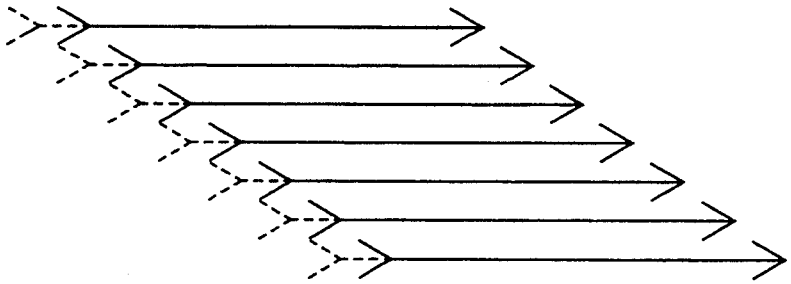
FIG. 10*d* is a control line diagram showing operation with equipped trains.

The other two combinations of trains are: equipped trains following equipped trains; and equipped trains following non-equipped trains. These combinations use the wayside virtual control system, such as shown in FIG. 10*d*. The position of all equipped trains are known by the wayside virtual block CPU. The non-equipped trains are also known by the wayside virtual block CPU system because it tracks the non-equipped trains using the existing track circuits and the existing trip stop positions. These additional inputs to the wayside virtual block system are shown in FIG. 9, 140, 144.

FIG. 11*a* shows a 2,000 foot track section, 155, as it would actually exist. FIG. 11*b* shows how the track section 155 could be utilized in a discrete track circuit system to have two track circuits TC1, TC2 each of approximately 1,000 foot. FIG. 11c shows the same 2,000 foot track circuit 155 as it would be used in a virtual block system, having one zone B which would have communication within that zone to vehicles traveling in zone B. FIG. 11*d* is a diagrammatic representation of zone B which shows how the same track section, 155, is represented by the wayside CPU as having a plurality of virtual track circuits VTC1 through VTC200. In this example each virtual track circuit would represent approximately 10 foot of actual track. In this system any number of virtual track circuits can be used and the representative length of each virtual track circuit can be picked to optimize the train control desired in that area. Since the virtual track circuits exist as a software implemented tool the equipment can be programmed to have 200 track circuits per zone, or just as easily having 10, 20, or 50 track circuits in zone B. Similarly the virtual track circuit in a zone need not be of equal length, some may be small (10 to 100 foot), others large (200 to 1,000 foot). Any length can be used and various lengths can be used in sections of the zone requiring more control. A comparison of FIG. 11*b* and 11*d* show the increased resolution of control provided by the virtual track circuit system.

Figure 12:
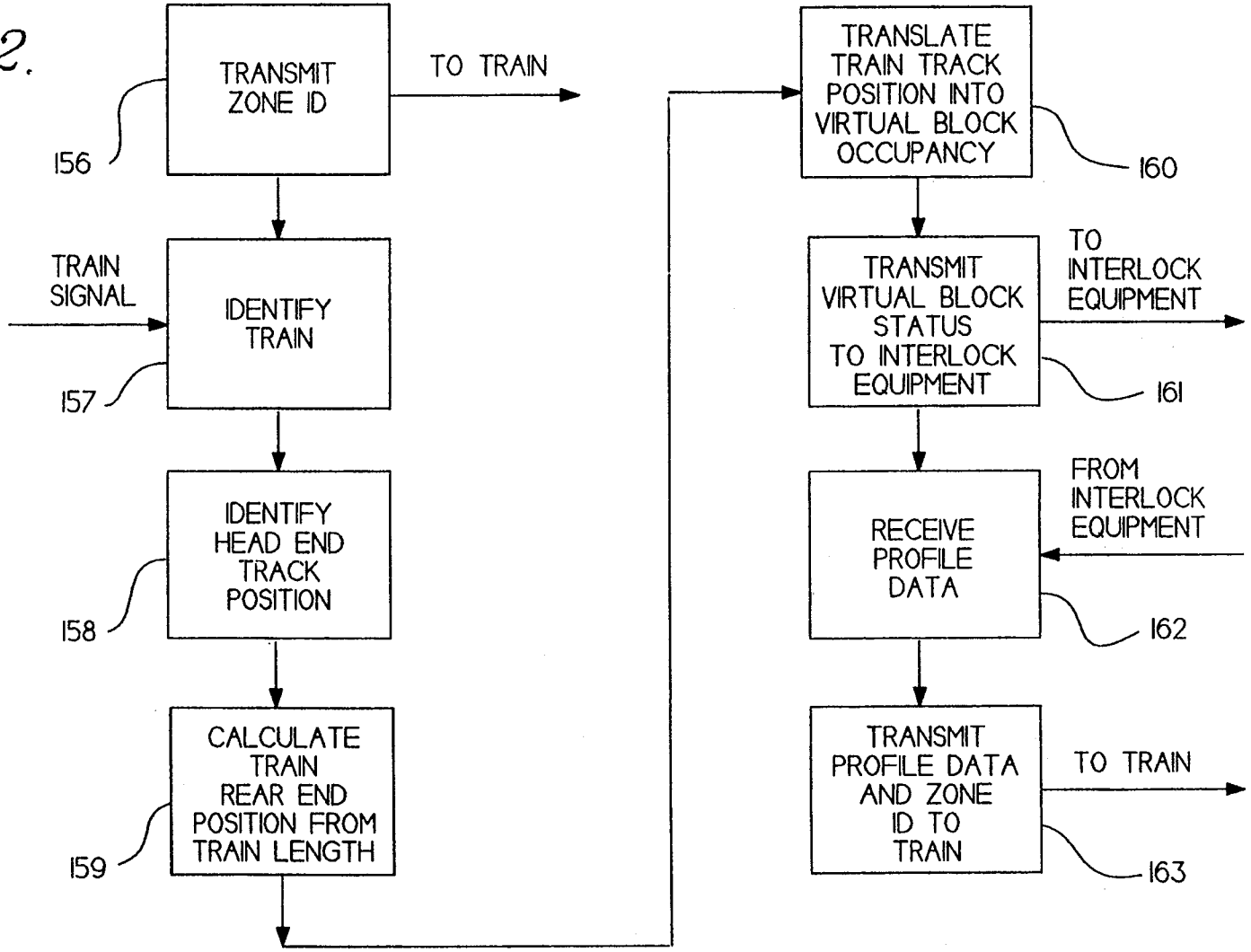
FIG. 12 is a diagrammatic representation of a flow chart of a wayside CPU unit which is used to translate train position data into virtual track circuit occupancy data.

FIG. 12 shows a flow diagram of the wayside CPU. This diagram shows some of the preferred functions performed by the CPU, but it is understood that the CPU may have additional capacity and other functions or data communication may also be performed by this equipment in various embodiments of the invention. The wayside equipment transmits a zone ID signal to the track area within the given zone, 156. The unit then listens for a communication from a vehicle, train, within the zone. When a train signal is received the wayside equipment identifies the train and a check may also verify the zone ID from the signal received from the train. This assures that the wayside equipment is communicating with a train that is within its zone. The train signal includes an identification of the actual position on the track or location within the zone. This will usually be the head end of the vehicle, but other predetermined vehicle positions may be used in association with identifying the vehicle's actual position or location. The wayside unit then knows the head end location and can relate it to an actual track position within its zone. Since the train signal also included the vehicle's length, the wayside equipment can also calculate, 159, the actual position of the rear end of the train. The unit now has available the head end and the rear end locations of the train within its zone. It can translate, 160, this train actual location into a signal which is indicative of an occupied virtual track circuit or block. Its output of the virtual block status of all of the virtual block track circuits within its zone, 161, is preferably done in a style indicative of actual track circuits occupancy status. The wayside interlocking equipment therefore does not know whether it is communicating with virtual track circuits through the wayside CPU or actual track circuits. This is particularly advantageous where the virtual track circuit system is installed over existing actual physical track circuit equipment, and it is desirable to operate in either a physical track circuit mode or a virtual track circuit mode. Additionally, since personnel are very familiar with the prior art physical track circuit equipment, the interfacing and trouble shooting of the virtual block equipment is greatly simplified.

After the wayside CPU transmit the virtual block occupancy status to the interlock equipment, it then receives profile data from the interlock equipment, 162. This profile data is transmitted to the rail vehicle 163. It is also advantageous to transmit the zone ID with the profile data. This assures that the train interprets only information from its respective zone. The zone ID signal transmitted in block 153 may in fact be a periodic zone transmittal message which is functionally also transmitted in block 156.

Figure 13:
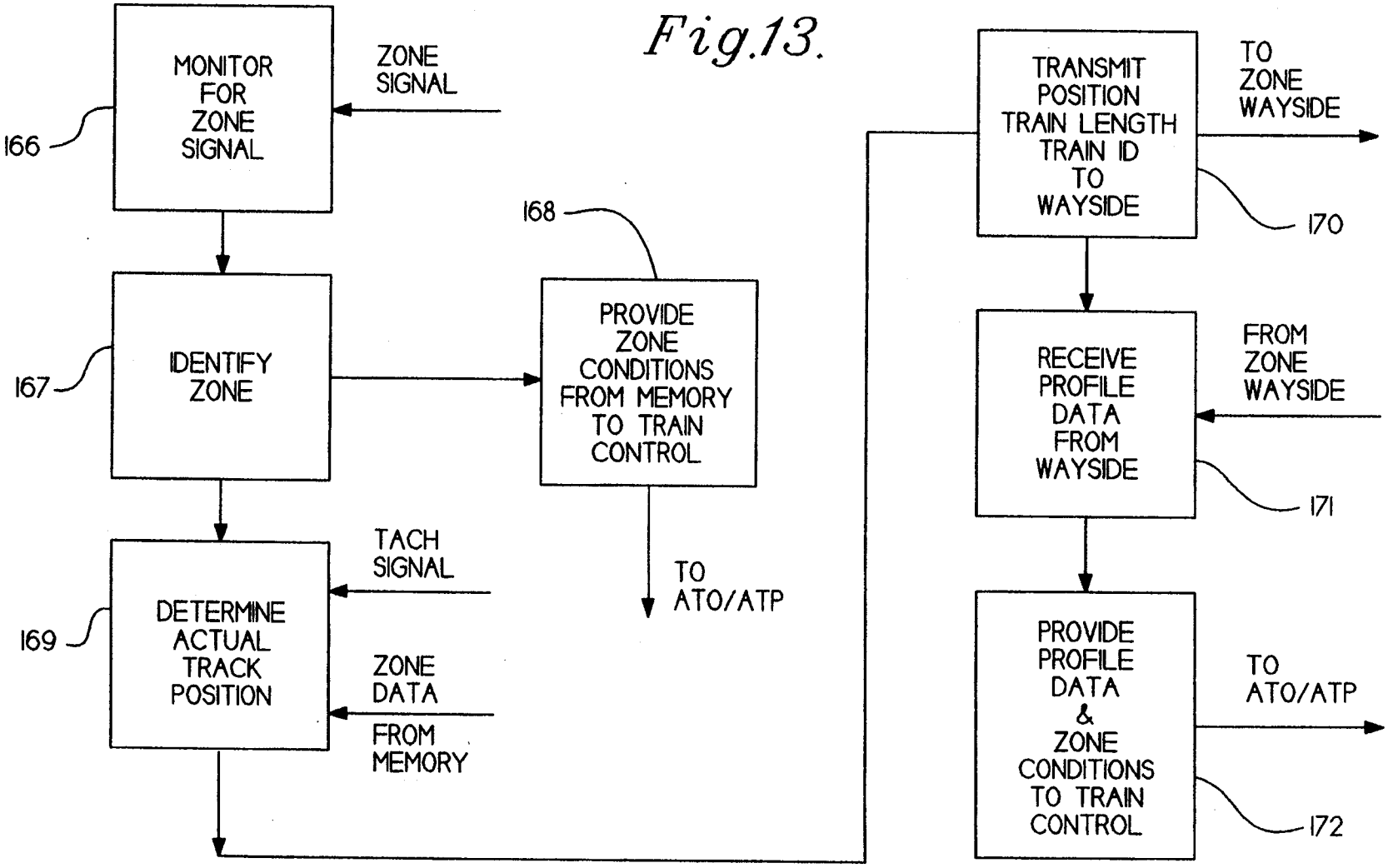
FIG. 13 is a diagrammatic flow chart showing a carborne CPU used to communicate between a zone and carborne train control equipment.

FIG. 13 shows a flow chart for some of the functions that may be provided by the carborne CPU unit. The vehicle equipment as it traverses the track monitors for a zone signal, 166. As a zone signal is received the zone is identified, 167, and additional zone conditions from the carborne memory can be provided to the carborne train control equipment, 168. Some of these conditions may include the length of the zone in actual distance and the track grade or other condition associated with the zone. The car may also have data to interrelate the zones to each other and to various track parameters.

After the zone has been identified by,the carborne equipment, the carborne equipment can determine its actual track position, 169. The actual track position is obtained from the zone data and from the information that it has received by having initially received a zone signal. The actual track position of the vehicle can be up-dated periodically or continuously by using its initial position upon entering the zone in combination with a movement or distance sensor for its travel within the zone. Typically a tach sensor can be used which outputs revolutions of a vehicle wheel, the circumference of which can be programmed into the carborne equipment, CPU. The actual position of the vehicle can therefore be calculated to a very high precision. The actual position of the train is periodically transmitted to the wayside equipment, 170. The same transmission will also usually include the train length and the train ID. Other information, such as an affirmance of the zone in which the vehicle perceives itself to be located, can also be transmitted. The carborne CPU also can receive the profile data from the wayside equipment, 171, and can add zone conditions to the profile data 172, and then provide such profile data and zone conditions to the carborne ATO/ATP equipment.

Because the virtual block system does not require the existing signaling system to be shut down or removed, the installation of virtual block equipment in a system does not require that the system be shut down. Vehicles can be equipped with the carborne virtual block system unit and operate compatibly with the existing track circuit equipment. The wayside equipment can similarly be interfaced to the virtual block system, and the complete system can then be cut-over to the virtual block operation after each sub-system has been installed and tested.

The failure modes for the virtual block system can be studied using three major sub-systems. These major sub-systems are the wayside interlocking unit, the wayside CPU, and the carborne CPU. The wayside interlocking unit is generally redundant. If this unit fails, all virtual track circuits are indicated as occupied, and all trains can be stopped. This failure mode is the same as traditional physical track circuit systems using individual track circuit equipment. Once the interlocking unit comes out of re-set, the wayside CPU supplies the interlocking equipment with data indicating which virtual track circuits are unoccupied.

The wayside CPU unit can be made redundant also. If this wayside CPU unit fails, all virtual tracks circuits are then considered by the wayside interlocking equipment to be in the zone controlled by the failed wayside CPU. All trains within the applicable zone controlled by the shut down wayside CPU are then stopped. When the wayside CPU comes out of reset, the communication dialogue starts again and the position of each train is determined before any train is permitted to move in the zone. Because the track system is composed of a number of wayside CPUs, failure of a wayside CPU unit only reduces service within that respective zone or zones controlled by that CPU. The zones of other CPUs that are unaffected in the system continue to operate. If special measures are instituted, such as manual operation within the failed zone, at greatly reduced speeds, the whole system can provide acceptable performance. The whose system is not shut down.

The carborne CPU can be made redundant also. If this carborne unit fails, the vehicle is stopped. The wayside CPU controlling the zone in which the vehicle is stopped maintains the respective virtual track circuits occupied until a dialogue is started again with the vehicle. Because the recovered vehicle may not know its exact location in the zone, the wayside interlocking equipment extends the control line for that vehicle to the enter length of the zone. The vehicle, however, will know its zone ID from receipt of the zone signal from wayside. Once the vehicle enters a new zone, the virtual track circuit control lines resume for the predetermined shorter length virtual track circuits. During the re-set of a failure in this mode, the zone acts as one track circuit.

If the carborne traditional automatic train control (ATC) fails the vehicle is stopped. This ATC package is also traditionally made redundant, and once re-set the vehicle can proceed as before. The new position of the vehicle can be maintained by the tachometer if working. If the tachometer pulses are not received by the carborne CPU during the failure of the traditional ATC package, the vehicle proceeds as described in the case of a re-set of the carborne CPU.

While the invention has been described with a view to some of the presently preferred embodiments, it is to be understood that other embodiments will be apparent to those skilled in the art upon review of the invention.

I claim:

1. An apparatus for control of a rail vehicle on a section of track having corresponding wayside interlocking equipment and carborne train operation equipment, such wayside interlocking equipment corresponding with at least one wayside zone, such apparatus comprising:

receiving means for receiving data relating to the physical location of such rail vehicle within such zone;

wayside CPU means for translating said location into occupancy signals representative of a plurality of virtual blocks within such zone;

means for sending said occupancy signals representative of said virtual blocks to such wayside interlocking equipment;

such wayside equipment having means for generating profile data indicative of operation of such rail vehicle within such zone; and wayside transmitter means for transmitting said profile data to said rail vehicle.

2. The apparatus for control of a rail vehicle of claim 1 further comprising:

location determining means on such rail vehicle for determining said location of such rail vehicle within such zone.

3. The apparatus for control of a rail vehicle of claim 2 wherein said wayside transmitter means further comprises:

means for transmitting a zone signal within such zone to said rail vehicle; and such rail vehicle includes means to receive said zone signal.

4. The apparatus for control of a rail vehicle of claim 3 further comprising:

sensor means on such rail vehicle to detect movement of such rail vehicle within such zone.

5. The apparatus for control of a rail vehicle of claim 4 wherein said location determining means uses the initial receipt of said zone signal and the output of said sensor means to determine said location of such rail vehicle.

6. The apparatus for control of a rail vehicle of claim 5 wherein said location is transmitted from such rail vehicle by a data radio on such rail vehicle.

7. The apparatus for control of a rail vehicle of claim 6 wherein said wayside transmitter means includes a radio for transmitting said zone signal to such rail vehicle.

8. The apparatus for control of a rail vehicle of claim 2 wherein said location is transmitted from such rail vehicle by a data radio on such rail vehicle.

9. The apparatus for control of a rail vehicle of claim 8 wherein said wayside transmitter means includes a radio for transmitting a zone signal to such rail vehicle.

10. The apparatus for control of a rail vehicle of claim 9 wherein said wayside transmitter means periodically transmits said zone signal.

11. The apparatus for control of a rail vehicle of claim 2 wherein said receiving means further comprises:

means for receiving other data related to the specific such rail vehicle at said location; and said other data includes the length of such specific rail vehicle.

12. The apparatus for control of a rail vehicle of claim 11 wherein said other data further includes the identification of such specific rail vehicle.

13. The apparatus for control of a rail vehicle of claim 12 wherein said wayside transmitter means transmits a zone identification; and data radio means on such rail vehicle to transmit back such zone identification to such receiving means.

14. The apparatus for control of a rail vehicle of claim 1 wherein such section of track includes a plurality of such zones.

15. The apparatus for control of a rail vehicle of claim 14 wherein said plurality includes two zones covered by an interlocking room; and wherein such wayside equipment for said two zones is included in said interlocking room.

16. The apparatus for control of a rail vehicle of claim 14 wherein said wayside transmission means further includes a lossy coax antenna generally adjacent the track section within such zone.

17. The apparatus for control of a rail vehicle of claim 1 wherein said carborne train operation equipment includes automatic train operation equipment.

18. The apparatus for control of a rail vehicle of claim 17 wherein such carborne train operation equipment includes means for calculating a safe braking distance.

19. The apparatus for control of a rail vehicle of claim 1 wherein such carborne train operation equipment includes means for calculating a safe braking distance.

20. The apparatus for control of a rail vehicle of claim 1 wherein said wayside CPU means further includes means to accept signal from physical track circuits.

21. The apparatus for control of a rail vehicle of claim 20 wherein said wayside CPU means converts said signals from said physical track circuits to signals corresponding to representative ones of said virtual blocks.

22. The apparatus for control of a rail vehicle of claim 21 wherein:

said wayside CPU means further includes means to convert said profile data corresponding to said virtual blocks to profile data corresponding to said physical track circuits; and said wayside transmitter means further includes means for transmitting said profile data corresponding to said physical track circuits.

23. An apparatus for control of a rail vehicle on a section of track having corresponding wayside interlocking equipment and carborne train operation equipment, such wayside interlocking equipment corresponding with at least one wayside zone, such apparatus comprising:

wayside transmitter means for transmitting a zone signal within such zone;

carborne receiver means for receiving said zone signal; and location determining means on such rail vehicle for calculating the location of such rail vehicle within such zone from said zone signal.

24. The apparatus for control of a rail vehicle of claim 23 wherein said location determining means uses the initial receipt of said zone signal at the entrance to such zone to calculate such rail vehicle location.

25. The apparatus for control of a rail vehicle of claim 24 further comprising:

sensor means on such rail vehicle to detect movement of such rail vehicle within such zone.

26. The apparatus for control of a rail vehicle of claim 25 wherein said location determining means uses the initial receipt of said zone signal and the output of said sensor means to determine said location of such rail vehicle within such zone.

27. The apparatus for control of a rail vehicle of claim 26 wherein said location is transmitted from such rail vehicle by a data radio on such rail vehicle.

28. The apparatus for control of a rail vehicle of claim 23 wherein said location is transmitted from such rail vehicle by a data radio on such rail vehicle.

29. The apparatus for control of a rail vehicle of claim 27 wherein said data radio includes means for transmitting the length of such rail vehicle.

30. The apparatus for control of a rail vehicle of claim 28 wherein said data radio includes means for transmitting the length of such rail vehicle.

31. The apparatus for control of a rail vehicle of claim 29 wherein said receiver means includes means for receiving said zone signal.

32. The apparatus for control of a rail vehicle of claim 30 wherein said receiver means includes means for receiving said zone signal.

33. The apparatus for control of a rail vehicle of claim 31 wherein said data radio includes means for transmitting the identification of such zone.

34. The apparatus for control of a rail vehicle of claim 32 wherein said receiver means includes means for receiving said zone signal.

35. The apparatus for control of a rail vehicle of claim 28 wherein said receiver means includes means for receiving said zone signal.

36. The apparatus for control of a rail vehicle of claim 35 further comprising a data radio for transmitting said zone signal from such rail vehicle to wayside.

37. The apparatus for control of a rail vehicle of claim 23 further comprising means for storing the length of such zone on such rail vehicle.

38. The apparatus for control of a rail vehicle of claim 35 further comprising means for storing the length of such zone on such rail vehicle.

39. The apparatus for control of a rail vehicle of claim 23 wherein said location is transmitted from such rail vehicle by a data radio on such rail vehicle.

40. An apparatus for control of a rail vehicle on a section of track having corresponding wayside interlocking equipment and carborne train operation equipment, such wayside interlocking equipment corresponding with at least one wayside zone, such apparatus comprising:

wayside transmitter means for transmitting a zone signal within such zone;

carborne receiver means for receiving said zone signal;

location determining means on such rail vehicle for calculating the location of such rail vehicle within such zone from said zone signal and said location is transmitted from such rail vehicle by a data radio on such rail vehicle; and wayside CPU means for translating said location in occupancy signals representative of a plurality of virtual blocks within such zone.

41. The apparatus for control of a rail vehicle of claim 40 further comprising:

wayside means for calculating profile data; and wayside transmitter means for transmitting said profile data to such rail vehicle in such zone.

42. The apparatus for control of a rail vehicle of claim 41 wherein said data radio periodically transmits said location; and said wayside transmitter means periodically transmits said zone identification.

43. The apparatus for control of a rail vehicle of claim 42 wherein said wayside transmitter means periodically transmits a zone identification.

44. A method of controlling a rail vehicle on a section of track, such section of track having at least one wayside zone, said method comprising:

receiving at wayside a location signal from such rail vehicle that is representative of the location of such rail vehicle within such zone;

translating said location into occupancy signals representative of a plurality of virtual blocks within such zone; and sending such occupancy signals to interlocking equipment.

45. The method of controlling a rail vehicle on a section of track of claim 44 further comprising:

transmitting said location signal from such rail vehicle to wayside within such zone.

46. The method of controlling a rail vehicle on a section of track of claim 44 further comprising:

calculating the occupancy of said virtual track blocks from the location of the rail vehicle within such zone and the length of such rail vehicle.

47. The method of controlling a rail vehicle on a section of track of claim 46 further comprising:

transmitting a zone signal adjacent the track within such zone.

48. The method of controlling a rail vehicle on a section of track of claim 47 further comprising:

calculating the location of such rail vehicle on board such rail vehicle from the receipt of said zone signal within such zone.

49. The method of controlling a rail vehicle on a section of track of claim 47 further comprising:

sensing movement of said rail vehicle within such zone; and calculating the location of such rail vehicle on board such rail vehicle from the initial receipt of said zone signal within such zone and from the movement of such rail vehicle within such zone.

50. The method of controlling a rail vehicle on a section of track of claim 49 further comprising:

transmitting to wayside the length of such rail vehicle.

51. The method of controlling a rail vehicle on a section of track of claim 50 wherein said zone signal includes:

transmitting a zone identification to such rail vehicle.

52. The method of controlling a rail vehicle on a section of track of claim 51 further includes:

after receipt of said zone signal by such rail vehicle transmitting said zone identification from said rail vehicle to wayside.

53. The method of controlling a rail vehicle on a section of track of claim 44 further comprising:

receiving signals to wayside from physical track circuits within such zone; and translating said signals from physical track circuits into representative virtual block occupancy signals.

54. The method of controlling a rail vehicle on a section of track of claim 45 further comprising:

receiving signals at wayside from physical track circuits within such zone; and translating said signals from physical track circuits into representative virtual block occupancy signals.

55. A method of controlling a rail vehicle on a section of track, such section of track having at least one wayside zone, said method comprising:

transmitting a zone signal adjacent such zone;

receiving said zone signal upon such vehicle initially entering such zone; and calculating the position of such rail vehicle within such zone from the initial receipt of said zone signal.

56. The method of controlling a rail vehicle on a section of track of claim 55 further comprising:

sensing movement of such rail vehicle within such zone; and calculating the location of such rail vehicle on board such rail vehicle from the initial receipt of said zone signal within such zone and from the movement of such rail vehicle within such zone.

57. The method of controlling a rail vehicle on a section of track of claim 56 further comprising transmitting said location to wayside.

58. A method of controlling a rail vehicle on a section of track, such section of track being representative of at least one wayside zone, said method comprising:

transmitting a zone signal adjacent such zone;

receiving said zone signal upon such vehicle initially entering such zone;

calculating the position of such rail vehicle within such zone from the initial receipt of said zone signal;

sensing movement of such rail vehicle within such zone;

calculating the location of such rail vehicle from the initial receipt of said zone signal within such zone and from the movement of such rail vehicle within such zone;

transmitting said location to wayside; and translating at wayside said location into occupancy signals for a plurality of virtual track blocks.

59. The method of controlling a rail vehicle on a section of track of claim 56 further comprising:

transmitting said location, and the length of such rail vehicle from such rail vehicle to wayside.

60. The method of controlling a rail vehicle on a section of track of claim 57 wherein said zone signal includes:

transmitting a zone identification to such rail vehicle.

61. The method of controlling a rail vehicle on a section of track of claim 60 further includes:

after receipt of said zone signal by such rail vehicle transmitting said zone identification from such rail vehicle to wayside.

* * * * *

US005398894B1

REEXAMINATION CERTIFICATE (3640th)

United States Patent [19] [11] B1 5,398,894

Pascoe [45] Certificate Issued Sep. 29, 1998

[54] VIRTUAL BLOCK CONTROL SYSTEM FOR RAILWAY VEHICLE

[75] Inventor: Robert D. Pascoe, Pittsburgh, Pa.

[73] Assignee: Union Switch & Signal Inc., Pittsburgh, Pa.

Reexamination Request:
No. 90/004,836, Nov. 13, 1997

Reexamination Certificate for:

| | |
|---|---|
| Patent No.: | **5,398,894** |
| Issued: | **Mar. 21, 1995** |
| Appl. No.: | **104,875** |
| Filed: | **Aug. 10, 1993** |

[51] Int. Cl.[6] ..... B61L 25/00
[52] U.S. Cl. ..... 246/28 R; 246/62; 246/122 R
[58] Field of Search ..... 246/182 R, 182 B, 246/182 C

[56] References Cited

FOREIGN PATENT DOCUMENTS 0 375 553 12/1989 European Pat. Off. .
539885 5/1993 European Pat. Off. ..... 246/182 R
2 225 887 10/1988 United Kingdom .

*Primary Examiner*—Mark Tuan Le

[57] ABSTRACT

A virtual block system is provided in which a section of track is represented by a zone having a plurality of virtual track circuits. Communication between wayside and the vehicle is established within the zone, and may be used to provide the initial position of the vehicle to the carborne equipment. The carborne equipment can then calculate and up-date its position within the zone by using its initial position and sensor information relative to its movement within the zone. The actual positive within the zone can be transmitted from the vehicle to the wayside equipment. The wayside equipment converts the actual position within the zone to a virtual track circuit occupancy. The wayside equipment may also use the train length to calculate one or more virtual blocks as being occupied. The wayside unit outputs the occupancy status, occupied or unoccupied, to the wayside interlocking equipment. The wayside equipment generates profile data which can be transmitted to the vehicle.

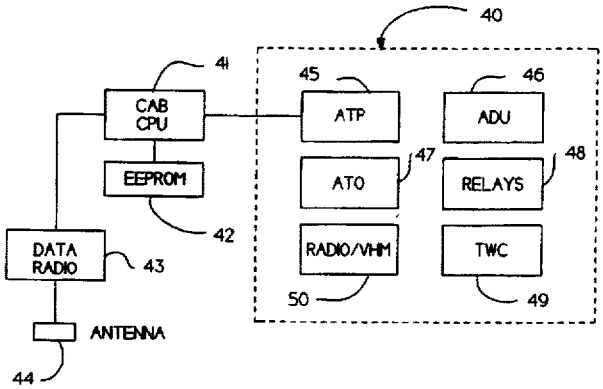

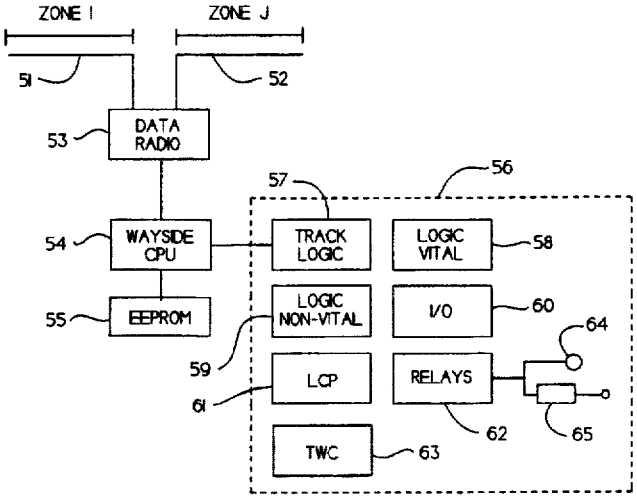

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 41, 59 are cancelled.

Claims 1, 15, 22–23, 40, 42, 44, 55 and 58 are determined to be patentable as amended.

Claims 2–14, 16–21, 24–39, 43, 45–54, 56–57 and 60–61, dependent on an amended claim, are determined to be patentable.

New claims 62–63 are added and determined to be patentable.

1. An apparatus for control of a rail vehicle on a section of track having corresponding wayside interlocking equipment and carborne train operation equipment, such apparatus comprising:

receiving means for receiving data relating to the physical location of such rail vehicle within such zone;

CPU means wayside for translating said location into occupancy signals representative of a plurality of virtual blocks within such zone;

means for sending said occupancy signals representative of said virtual blocks to such wayside interlocking equipment;

such wayside equipment having means for generating profile data *that is a function of the occupancy of said plurality of virtual blocks, said profile data being* indicative of the operation of such rail vehicle within such zone; and wayside transmitter means for transmitting said profile data to said rail vehicle.

15. [The apparatus for control of a rail vehicle of claim 14] *An apparatus for control of a rail vehicle on a section of track having corresponding wayside interlocking equipment and carborne train operation equipment, such apparatus comprising:*

*receiving means for receiving data relating to the physical location of such rail vehicle within such zone;*

*CPU means wayside for translating said location into occupancy signals representative of a plurality of virtual blocks within such zone;*

*means for sending said occupancy signals representative of said virtual blocks to such wayside interlocking equipment;*

*such wayside equipment having means for generating profile data indicative of the operation of such rail vehicle within such zone;*

*wayside transmitter means for transmitting said profile data to said rail vehicle;*

*wherein such section of track includes a plurality of such zones;* wherein said plurality includes two zones covered by an interlocking room; and wherein such wayside equipment for said two zones is included in said interlocking room.

22. The apparatus for control of a rail vehicle of claim 21 wherein:

said CPU means further includes means to convert said [profile data] *signals* corresponding to said virtual blocks to profile data corresponding to said physical track circuits; and said wayside transmitter means further includes means for transmitting said profile data corresponding to said physical track circuits.

23. An apparatus for control of a rail vehicle on a section of track having corresponding wayside interlocking equipment and carborne train operation equipment, such wayside interlocking equipment corresponding with at least one wayside zone, such apparatus comprising:

wayside transmitter means for transmitting a zone signal within such zone;

carborne receiver means for receiving said zone signal;

location determining means on such rail vehicle for calculating the location of such rail vehicle within such zone from said zone signal*;*

*wayside equipment means for generating profile data that is a function of the occupancy of said plurality of virtual blocks, said profile data being indicative of the operation of such rail vehicle within such zone; and*

*wayside transmitter means for transmitting said profile data to said rail vehicle.*

40. An apparatus for control of a rail vehicle on a section of track having corresponding wayside interlocking equipment and carborne train operation equipment, such wayside interlocking equipment corresponding with at least one wayside zone, such apparatus comprising:

wayside transmitter means for transmitting a zone signal within such zone;

carborne receiver means for receiving said zone signal;

location determining means on such rail vehicle for calculating the location of such rail vehicle within such zone from said zone signal and said location is transmitted from such rail vehicle by a data radio on such rail vehicle; [and]

wayside CPU means for translating said location in occupancy signals representative of a plurality of virtual blocks within such zone*;*

*wayside means for calculating profile data as a function of the occupancy of said plurality of virtual blocks, said profile data being indicative of the operation of such rail vehicle within such zone; and*

*wayside transmitter means for transmitting said profile data to such rail vehicle in such zone.*

42. The apparatus for control of a rail vehicle of claim [41] *40* wherein said data radio periodically transmits said location; and said wayside transmitter means periodically transmits said zone identification.

44. A method of controlling a rail vehicle on a section of track, such section of track having at least one wayside zone, said method comprising:

receiving at wayside a location signal from such rail vehicle that is representative of the location of such rail vehicle within such zone;

translating said location into occupancy signals representative of a plurality of virtual blocks within such zone;

*calculating profile data at wayside as a function of the occupancy of said plurality of virtual blocks, said profile data being indicative of the operation of such rail vehicle within such zone;*

*transmitting said profile data to such rail vehicle;* and sending such occupancy signals to interlocking equipment.

55. A method of controlling a rail vehicle on a section of track, such section of track having at least one wayside zone, said method comprising:

transmitting a zone signal adjacent such zone;

receiving said zone signal upon such vehicle initially entering such zone; and calculating the position of such rail vehicle within such zone from the initial receipt of said zone signal *and the length of such rail vehicle.*

58. A method of controlling a rail vehicle on a section of track, such section of track being representative of at least one wayside zone, said method comprising:

transmitting a zone signal adjacent such zone;

receiving said zone signal upon such vehicle initially entering such zone;

calculating the position of such rail vehicle within such zone from the initial receipt of said zone signal;

sensing movement of such rail vehicle within such zone;

calculating the location of such rail vehicle from the initial receipt of said zone signal within such zone and from the movement of such rail vehicle within such zone;

transmitting said location *and the length of such rail vehicle* to wayside; and translating at wayside said location *and said length* into occupancy signals for a plurality of virtual track blocks.

*62. The apparatus for control of a rail vehicle of claim 11 wherein said wayside CPU means translates said length and said location into said occupancy signals.*

*63. The apparatus for control of a rail vehicle of claim 40 wherein:*

*said location determining means further transmits the length of the rail vehicle by the data radio; and*

*said wayside CPU means translates said length and said location into said occupancy signals.*

* * * * *